US006261170B1

(12) United States Patent
Bell et al.

(10) Patent No.: US 6,261,170 B1
(45) Date of Patent: Jul. 17, 2001

(54) COIN DISPENSING MECHANISM

(75) Inventors: Mike Bell, West Yorkshire; Mark Paling, Lancashire, both of (GB)

(73) Assignee: Coin Controls Limited, Lancashire (GB)

( * ) Notice: Subject to any disclaimer, the term of this patent is extended or adjusted under 35 U.S.C. 154(b) by 0 days.

(21) Appl. No.: 09/068,553

(22) PCT Filed: Oct. 21, 1996

(86) PCT No.: PCT/GB96/02585

§ 371 Date: Jan. 11, 1999

§ 102(e) Date: Jan. 11, 1999

(87) PCT Pub. No.: WO97/18535

PCT Pub. Date: May 22, 1997

(30) Foreign Application Priority Data

Nov. 16, 1995 (GB) ..... 9523405

(51) Int. Cl.[7] ..... G07D 1/00; G07F 1/04

(52) U.S. Cl. ..... 453/57; 194/344

(58) Field of Search ..... 453/6, 10, 12, 453/32–35, 49, 50, 57; 194/344; 221/267

(56) References Cited

U.S. PATENT DOCUMENTS

| | | | | |
|---|---|---|---|---|
| 1,963,402 | * | 6/1934 | Comer | 194/344 X |
| 4,589,433 | * | 5/1986 | Abe | 221/203 X |
| 4,592,377 | * | 6/1986 | Paulsen et al. | 453/33 |

FOREIGN PATENT DOCUMENTS

| | | | |
|---|---|---|---|
| 2838746 | * | 3/1980 | (DE) . |
| 3830674 | * | 3/1990 | (DE) . |
| 213751 | | 9/1982 | (JP) . |
| 157642 | | 3/1991 | (JP) . |
| WO 91/10974 | * | 7/1991 | (WO) . |
| WO 93/21606 | * | 10/1993 | (WO) . |
| WO 95/05645 | * | 2/1995 | (WO) . |

* cited by examiner

*Primary Examiner*—F. J. Bartuska
(74) *Attorney, Agent, or Firm*—Arent Fox Kintner Plotkin & Kahn, PLLC

(57) ABSTRACT

A coin dispensing mechanism including a rotatable plate, coin handling device being arranged on one side of the plate, and plate drive device being arranged on the other side of the plate, such that the plate provides a physical barrier separating the drive function from the coin handling function.

9 Claims, 4 Drawing Sheets

COIN DISPENSING MECHANISM

BACKGROUND OF THE INVENTION

Our co-pending PCT application number PCT/GB 96/01763 relates to dispensing mechanisms and more particularly, but not exclusively, to a coin or token handling mechanism for use in vending machines, amusement or gaming machines, change giving machines or any other machine that requires a pay-out of coins or tokens to be made, for instance in the form of a prize or as change.

For simplicity, the word coin used in our co-pending application and in this application represents both coins and tokens.

Our co-pending application defined and described various improvements to one known type of coin dispensing mechanism. The known type of coin dispensing mechanism comprises a hopper containing a rotatable disc, the plane of the disc being inclined at an angle to the vertical. The disc carries pegs and as the disc rotates, coins in the hopper are captured between the pegs and are lifted in a position in which they rest against the face of the disc. In the upper reaches of the disc there is a wiping arrangement which removes the coin from the disc and into a slot. The slot can be the exit point of the coin from the coin dispensing mechanism, or the start of a subsequent device.

SUMMARY OF THE INVENTION

The present application defines and describes further improvements to the known type of mechanism.

According to a first aspect of the present invention, a coin dispensing mechanism is provided comprising a rotatable plate, coin handling means being arranged on one side of the plate and plate drive means being arranged on the other side of the plate such that the plate provides a physical barrier separating the drive function from the coin handling function.

This keeps the coin handling part of the mechanism totally separate from the drive arrangement so that each of the separate functions can be optimized.

With the known arrangement utilising a rotatable disc, drive components pass through the disc into the coin handling area and include, for example, means to push the disc onto a bearing from the coin side of the disc.

According to a preferred embodiment of the present invention, in which the rotatable plate comprises a rotatable disc, means are provided to pull the disc onto a bearing from the drive side of the disc.

The bearing may comprise a flat friction bearing.

Thus, on one side of the disc, coins can be stored, churned, lifted and dispensed. On the other side of the disc, means can be provided to keep the disc stable, rotate the disc, and compensate for wear, misalignments and shock loads.

This aspect of the invention is beneficial to the coin handling side of the disc because there are no physical protrusions of the drive arrangement into the coin handling area. The central area of the disc may comprise a flat surface parallel to coin pick up and dispensing areas. Any fasteners holding the disc to the drive means do not protrude above this flat surface.

According to a second aspect of this invention, coin guide means are provided to guide coins as they move in a given direction in succession, adjacent coins touching each other edge to edge, the guide means defining a flow path for the coins such that as the coins move in the said one direction each coin is gradually twisted relative to the succeeding coin about the centre line of the coin which extends through the plane of the coin in the said one direction.

Thus a coin emerging from the output end of the guide means may lie in a plane which is at a substantial angle to the plane of a coin entering the guide means.

Providing guide means arranged to twist coins in this way enables coins to be moved within a guide while substantially reducing the risk that a shingling type coin jam will occur.

A shingling jam occurs when one end on coin manages to part slide alongside another end on coin in a guide slot until both become wedged so forming a physical barrier to further coin movement. When a shingling type jam does occur it can damage or deform the coins and the sides of the guide slot. The slot has to be unjammed by hand. This means that the host machine is out of commission until service personnel arrive.

Existing known slot designs have a number of disadvantages.

Firstly, for coins to slide smoothly within the hollow slot, there has to be a clearance between each coin and the width restraint of the slot. It is this clearance that means a shingling jam is possible. Non flat coins or insufficient clearance means that coins are reluctant to move within the slot which results in high wear rates, jerky coin movements, high coin to coin loads, and even a single coin might cause a jam if it is sufficiently bent.

If the contact faces where the coins touch each other are not exactly parallel then there is a component of force moving the coins apart, which positively assists in causing a shingling type jam, particularly with worn or damaged coins.

If however each coin is twisted slightly with respect to the adjacent coins about the coin centre line defined above, then the risk that one coin can slide past another is substantially reduced.

The optimum angle of twist to avoid one coin sliding past the other is 90° but lesser angles will work just as well provided the angle of twist relative to each other is sufficient.

One embodiment of coin twisting guide mechanism comprises a substantially flat strip defining a coin guide slot, the strip being twisted about its longitudinal axis, for example in a helical manner.

According to another embodiment, a coin twisting guide mechanism comprises a block of material within which a coin guide slot is defined, the slot being twisted about the longitudinal axis of the block.

Although the coin guide means for twisting coins is described herein for use with particular coin dispensing mechanisms, the coin guide means can be used to guide coins in any application.

According to a third aspect of the invention, a coin dispensing mechanism is provided having coin guide means arranged to guide coins to an exit from the guide means, the guide means being provided with means to flick each coin out of the exit, the flicking means also being arranged to change the dispensing direction of the coin as it is flicked out.

Preferably the coin flicking means comprises a spring loaded arm against which the coins are urged in succession as they move along the guide means towards the exit.

By appropriate positioning of the spring loaded arm, the arm can be caused to guide the coin in a new direction and then squeeze the coin, causing the coin to squirt out through the exit.

DESCRIPTION OF THE DRAWINGS

By way of example, specific embodiments of the present invention will now be described, with reference to the accompanying drawings in which.

DESCRIPTION OF THE PREFERRED EMBODIMENT

Figure 1:
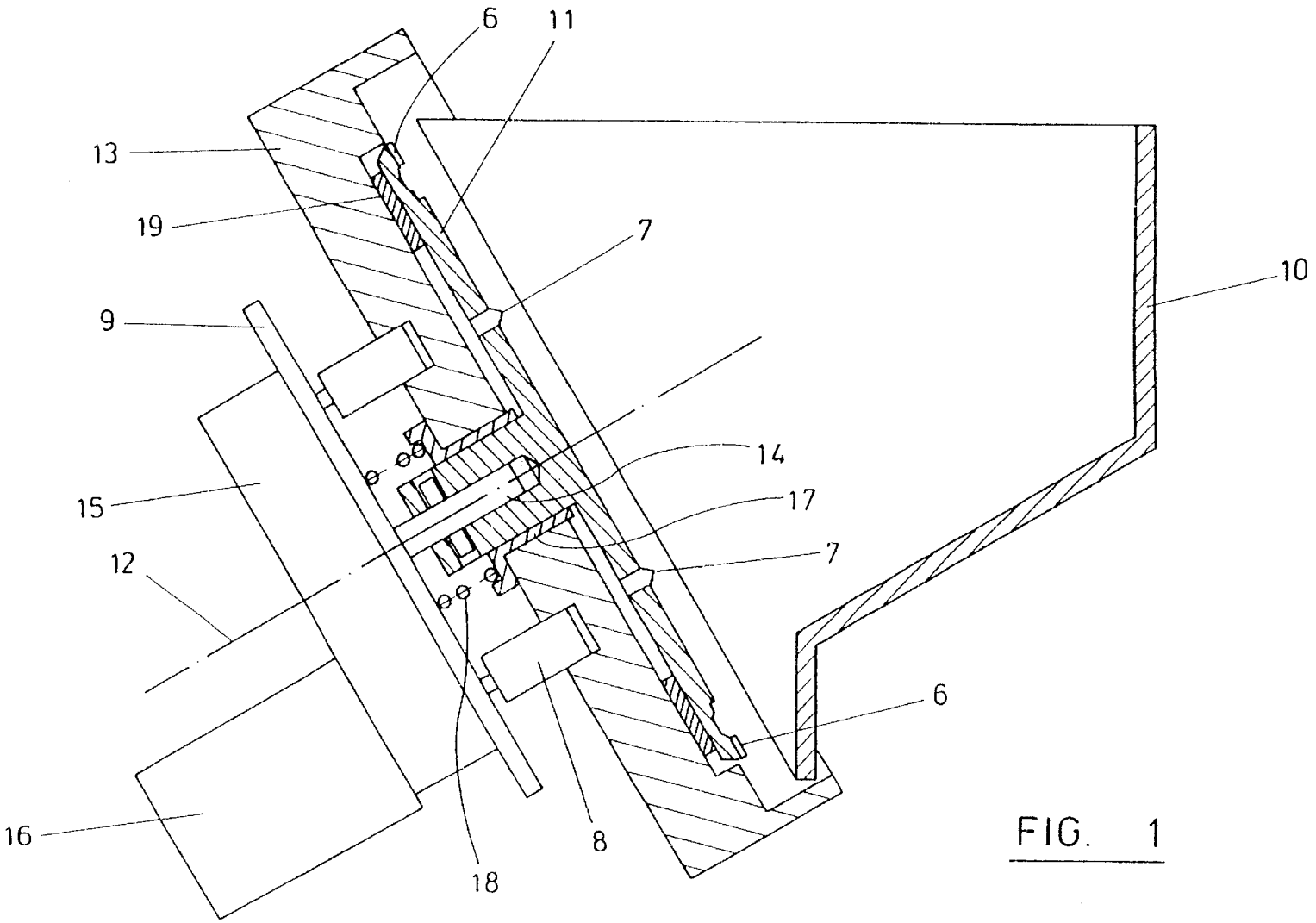
FIG. 1 is a diagrammatic cross-sectional view through a first embodiment of coin dispensing apparatus according to this invention.

FIG. 1 shows a hopper bowl 10 arranged to contain coins for dispensing. Position at an inclined angle at one side of the bowl is a coin dispensing disc 11. The disc 11 is mounted for rotation about an axis 12 within a rigid support 13. The disc is rotated by a shaft 14 which projects from a gear box 15 to which is coupled a drive motor 16. These components comprise a unit which can float in the direction of the axis 12 whilst the radial position is restrained by a rotary bearing 17. The unit is urged in the direction of the longitudinal axis 12 leading away from the bowl 10 by a compression spring 18 which acts between a motor mounting plate 9 and the rotary bearing 17. This also pulls the rear of the disc 11 into engagement with a flat friction bearing 19.

The arrangement shown compensates for wear between the back of the disc and the friction bearing 19 as compression spring 18 self adjusts to take up the extra longitudinal axis movement.

The gear box 15 requires a torque restraint between itself and an external fixing to ensure that the disc turns and not the gear box. This external fixing may be the rigid support 13. For example a resilient (e.g. rubber) restraint 8 may be provided between the plate 9 and the support 13. This restraint may take many forms. It may for example be combined with means to help cushion shock loads. Shock loads occur occasionally as an integral part of coin handling. For example a flexible member could be fitted between the gear box and the external fixing. This would absorb some of the shock load by allowing the gear box to twist partially about its own axis. This arrangement would give the visual appearance of the drive unit twitching whilst running. If more than one torque restraint is used, the torque restraints may be mounted about the axis 12.

The weight of the drive unit itself tends to help counter balance the bending moment created by coins pressing against the lower part of the disc 11. The radial bearing acts as the fulcrum.

The arrangement shown in FIG. 1 has a number of advantages.

For example the coin capacity of the hopper bowl 10 is increased compared to the prior art device, without changing the physical size of the bowl itself. This is because none of the drive components protrude beyond the disc into the hopper bowl.

The churning effect of the coins which takes place within the hopper bowl can mean that in certain circumstances an excessive number of coins are lifted toward the dispensing area at the same time. Such coin flooding in the upper reaches of the disc is to be avoided if possible as it can result in a jam. Because there are no drive protrusions into the hopper bowl with the arrangement shown in FIG. 1, there is a reduction in the blocking of the escape path of the excess coins back down to the lower reaches of the hopper bowl.

As the excess coins caused by flooding fall away from the dispensing area in the upper reaches, under gravity, they tend to slide parallel to the flat face of the disc towards the coin pick up areas in the lower reaches of the bowl. As these coins are already aligned with the disc, they are captured between the pegs of the disc more easily, and the result is an improved and more consistent coin dispensing rate for the whole machine.

The arrangement for stirring the coins in the hopper bowl can be better optimised with fewer physical obstructions. The stirring means may comprise one or more tapered hard pins 7 mounted on the disc, standing proud of the disc surface. The coin lifting pegs are shown at 6.

Figure 2B:
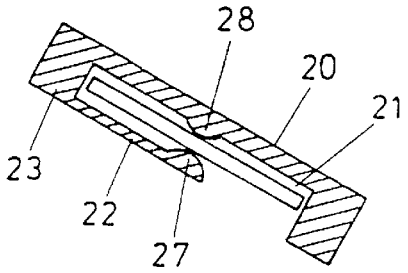
FIG. 2B is a cross-sectional view through one end of the coin guide means of FIG. 2A.
Figure 2A:
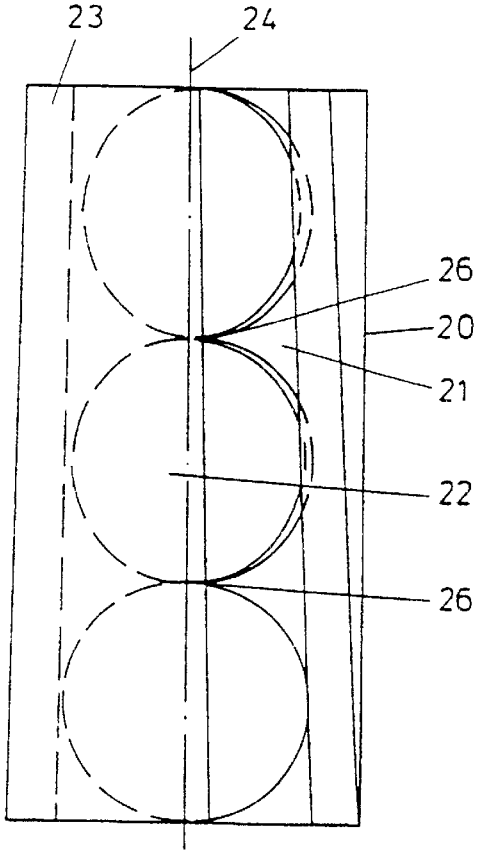
FIG. 2A is a side view of one embodiment of coin guide means according to the invention.
Figure 2C:
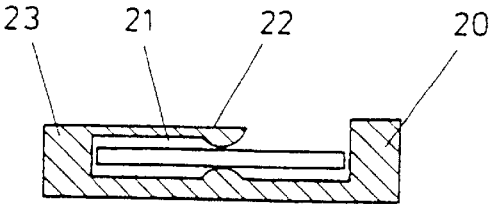
FIG. 2C is a cross-sectional view through the other end of the coin guide means of FIG. 2A.

Turning now to FIGS. 2A to 2C, there is shown a coin guide mechanism which is arranged to twist coins as they travel to reduce the likelihood of a shingling type coin jam.

The coin guide shown in FIGS. 2A to 2C comprises a generally flat strip 20 defining a guide slot 21 and having the cross-section shown in FIGS. 2B and 2C. Coins are retained in the guide slot by a strip 22 which projects from one of the sides 23 of the slot.

As will be seen from a comparison of FIGS. 2B and 2C, the component 20 twists gradually about its longitudinal axis 24, as coins 25 travel in the direction of the longitudinal axis.

As a result of this deliberately imparted twist, the coins are at an angle with respect to adjacent coins at the points 26 where coins touch whereas in prior art arrangements, the coins are in the same plane at these points. When the coins are in the same plane, this increases the risk that one coin will slide partially over another, resulting in a shingling type jam.

If the dimensions of the slot 21 were closely identical to the dimensions of the coins, then the twisting of the slot would tend to cause jamming of the coins so the slot is made substantially wider than the coins as can clearly be seen from FIGS. 2B and 2C, but contact between adjacent coins in the important central area is still maintained by the provision of projections 27 and 28 which reduce the width of the slot in the important central area to substantially the thickness of a coin.

Figure 3B:
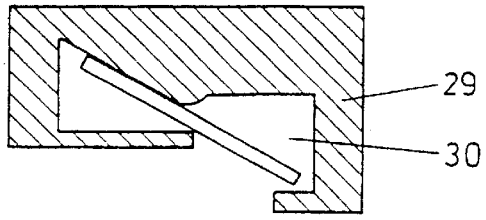
FIGS. 3A, 3B and 3C are views corresponding to FIGS. 2A, 2B and 2C, but illustrating another embodiment of coin guide means according to the invention.
Figure 3A:
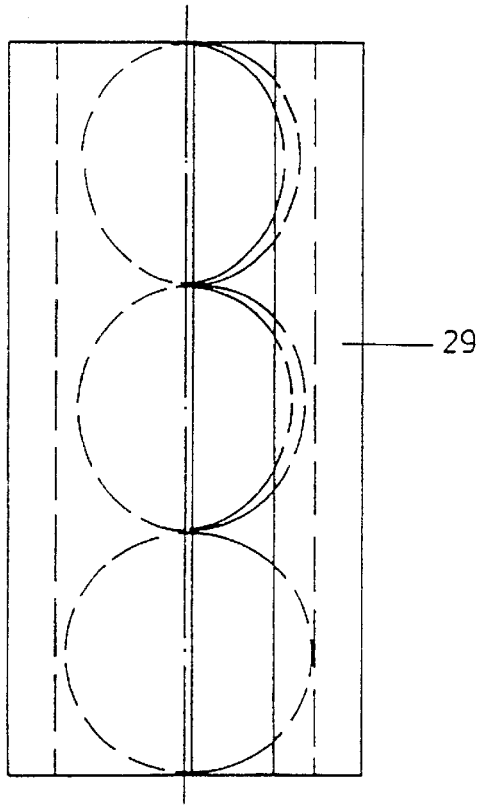
Figure 3C:
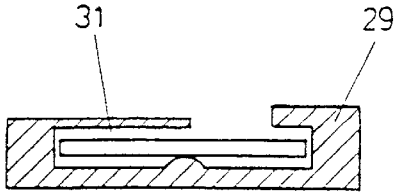

FIGS. 3A to 3B illustrate an alternative embodiment which has a similar action. In this embodiment a block of material 29 has a slot provided therein which changes in dimensions from the relatively deep slot shown in FIG. 3B at 30 to the relatively narrow slot shown at 31 in FIG. 3C. Thus coins can enter the slot with the orientation shown in FIG. 3B and they are then gradually twisted as they travel along the guide means to emerge with the orientation shown in FIG. 3C.

Coin twisting guide means such as those shown in FIGS. 2A to 2C and 3A to 3C can be used not only to reduce the possibility of shingling jams, but also in applications where coins specifically need to be turned, the coin entrance plane and the coin exit plane being different. It will also be apparent that the clearance between the coin and the width of the slot can be increased without a shingling type jam occurring. This has a number of advantages.

Firstly, non flat coins such as partly bent or partly domed coins are less likely to jam in the slot.

Worn coins or partly edged damaged coins can be moved through the slot without there being a likelihood of a shingling type jam.

Thin coins especially can be more reliably dispensed and discrepancies in the slot width itself become less important.

One application of the coin twisting mechanism shown would be with a disc form of coin dispensing mechanism such as that shown in FIG. 1. A coin twisting mechanism could be used to turn coins vertical after they have been dispensed from the inclined disc shown in FIG. 1. Coins would successively push each other through the coin twister after being dispensed by whatever means from the disc. At the coin twister exit the coins can then be dispensed or fed into another slot that guides the coins upwards prior to being dispensed at a higher location.

Figure 4B:
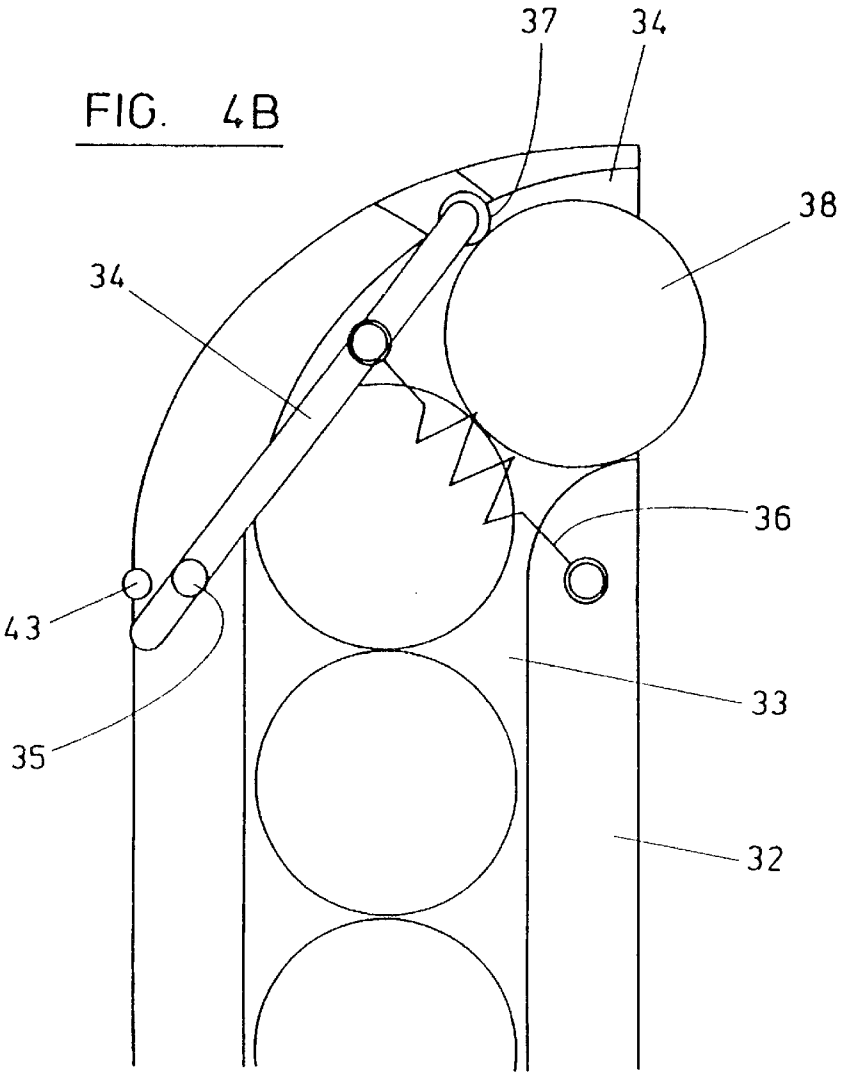
FIGS. 4A and 4B are side views illustrating the operation of one embodiment of coin flicking mechanism according to the invention.
Figure 4A:
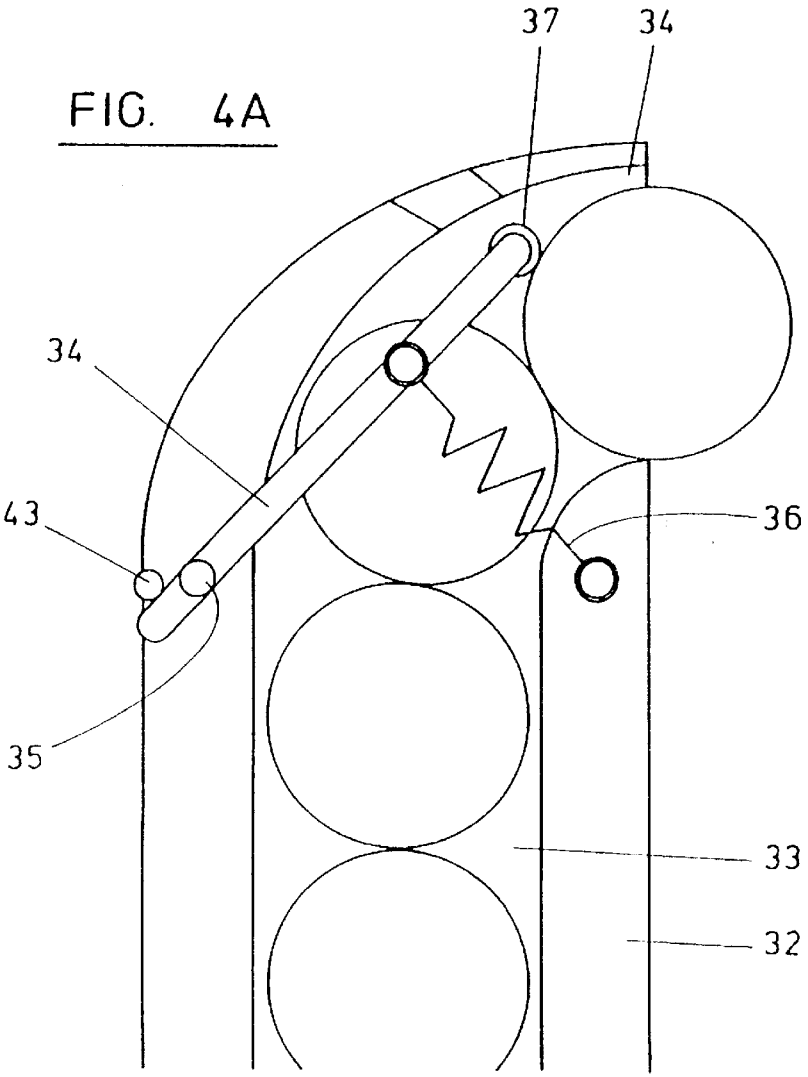

FIGS. 4A and 4B show an embodiment of coin guide mechanism in which coins are simultaneously turned and flicked out of an exit.

The mechanism shown in FIGS. 4A and 4B comprises a guide 32 which defines a coin guide slot 33. In this embodiment, the coin guide slot 33 extends upwardly but the coins are to be dispensed through an exit 34 which, in the embodiment extends horizontally.

In known arrangements, the guide means would be arranged to change the direction of the coins from vertical to horizontal and then the horizontally moving coins would be flicked out of an exit. In the embodiment shown in the Figures, change of direction and coin flicking is combined using a single mechanism.

An arm 34 is provided pivotally mounted at 35 at one side of the slot 33. The arm 34 is urged in the clockwise direction by means of a tension spring 36. A coin contact roller 37 is provided at the free end of the arm 34.

As each coin moves up the guide means 32 in succession, as each coin comes into contact with the roller 37 the force that the roller applies to the coin starts to change the direction of the coin from the vertical to the horizontal. As the coin pushes past the roller the arm is forced in the anticlockwise direction and energy is stored up in the spring 36. When a coin gets to the position shown in FIG. 4B where the coin 38 is about to move more than half way past the roller 37, the spring 36 is able to retract again and the stored energy acts on the coin 38 and flicks it out of the exit 34.

A mechanical stop 43 is provided so that the arm 34 cannot go over centre and jam.

In known mechanisms, where coins are already moving in a horizontal direction when they encounter a spring loaded arm, the action of the spring loaded arm forces the coin against a side of the slot and this produces a wedging action between the coin and the guide which creates additional resistance to movement. It also means that a coin will be either flicked out of the mechanism at various angles or has to continue to be guided for a short distance to correct the direction.

The arrangement shown in FIGS. 4A and 4B ensures that the side ways load of the spring loaded arm on the coin actually helps to move the coin in the desired direction.

The arrangement means that the length of a coin dispensing mechanism can be slightly reduced. Having a slightly shorter coin path within the guide means also reduces the likelihood that there will be jams.

Figure 5B:
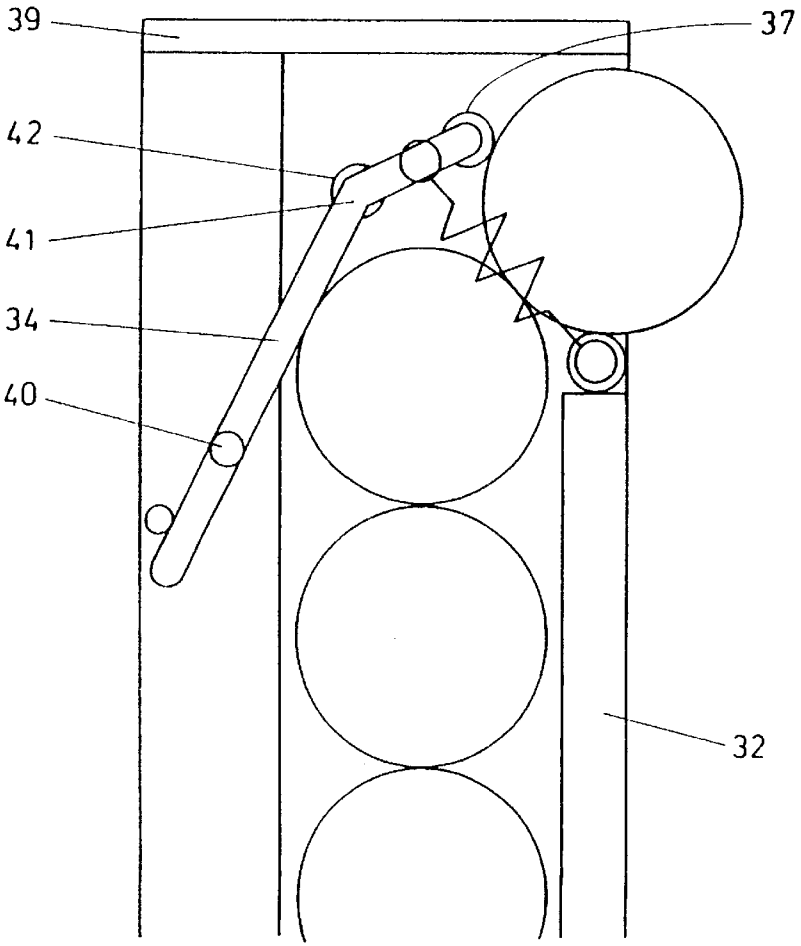
FIGS. 5A and 5B are views corresponding to FIGS. 4A and 4B but showing an alternative coin flicking mechanism.
Figure 5A:
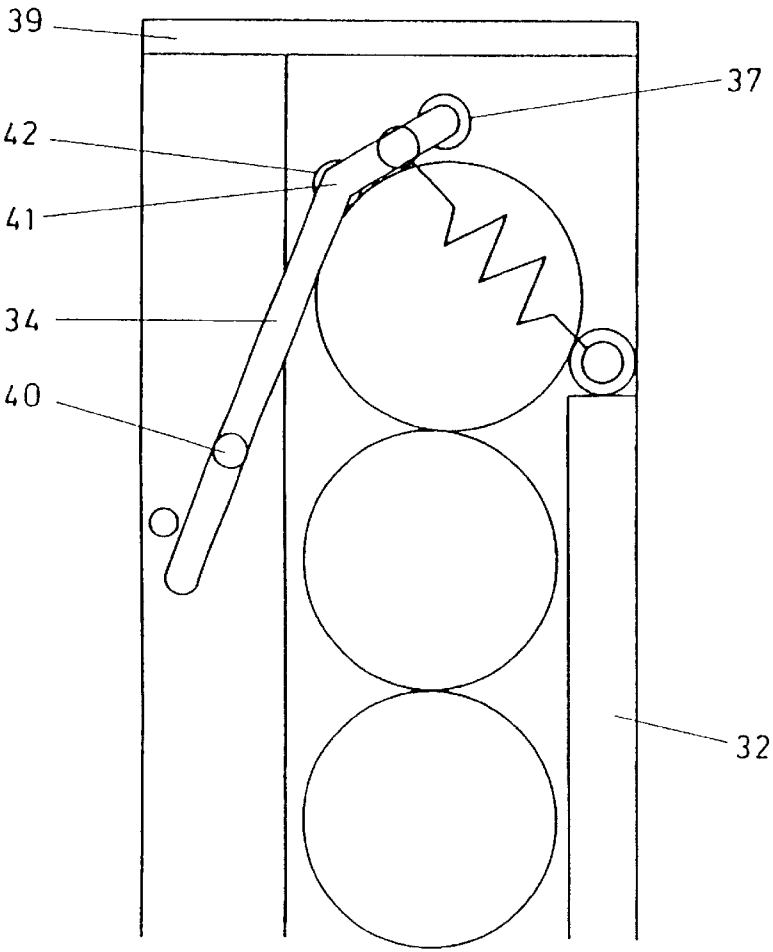

In the embodiment shown in FIGS. 4A and 4B, the guide means 32 has a curved upper end which is not particularly easy to manufacture. FIGS. 5A and 5B show an alternative embodiment which is easier to manufacture but which again utilizes a spring loaded arm 34 to bring about coin flicking and change of coin direction.

With the arrangement shown in FIGS. 5A and 5B, a standard length coin track 32 can be provided which can then be cut to length and fitted with a cap 39. The coin track 32 can be manufactured from a back plate and side members. The profile and the mounting position 40 of the arm 34 needs to change with different coin diameters. Thus a separate back plate does not have to be made for each coin size and/or escalator length. This is especially important with coin escalators and the length of an escalator has to be in multiples of the coin diameter being dispensed, i.e. so the top coin in the escalator is fully, not partly dispensed.

The arm 34 of the embodiment shown in FIGS. 5A and 5B is angled at 41 and at this point an additional roller 42 is provided to assist in guiding the coins along the right directional path.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A coin dispensing mechanism comprising:

a support member, plate drive means mounted on the support member for carrying out a plate drive function, a rotatable plate having first and second sides, positioned with the plate drive means on said first side of the rotatable plate, and coin handling means for carrying out a coin handling function, the coin handling means being positioned on said second side of said rotatable plate, said rotatable plate extending over said support member to provide a physical barrier completely separating the drive function from the coin handling function, so that coin handling takes place entirely on said first side of said rotatable plate and said drive function takes place entirely on said second side of said rotatable plate, wherein said rotatable plate comprises a rotatable disc, means being provided to pull the rotatable disc from the said second side of the rotatable disc towards said support member and onto a bearing.

2. A coin dispensing mechanism as claimed in claim 1, in which the bearing comprises a flat friction bearing.

3. A coin dispensing mechanism as claimed in claim 1, further comprising a coin guide that guides coins as they move in a given direction in succession, adjacent coins touching each other edge to edge, the coin guide including means for defining a longitudinal flow path for the touching coins which gradually twists about the longitudinal axis of the path, such that as the coins move in said direction, each coin is gradually twisted relative to the succeeding coin about the center line of the coin which extends through the plane of the coin in said direction, such that adjacent coins are not in the same plane, thus reducing the risk that one coin will ride over another coin and cause a jam.

4. The coin dispensing mechanism as claimed in claim 3, wherein the coin guide comprises a substantially flat strip defining a coin guide slot, the strip being twisted about its longitudinal axis, for example in a helical manner.

5. The coin dispensing mechanism as claimed in claim 3, wherein the coin guide comprises a block of material within which a coin guide slot is defined, the slot being twisted about the longitudinal axis of the block.

6. A coin dispensing mechanism as claimed in claim 1, in which the coin handling means comprises projections arranged on said one side of the rotatable plate and projecting away from the rotatable plate.

7. A coin dispensing mechanism as claimed in claim. 1, in which restraint means is positioned between the support member and the rotatable plate.

8. A coin dispensing mechanism as claimed in claim 7, in which the restraint means comprises at least one resilient member which helps to cushion shock loads.

9. The coin dispensing mechanism as claimed in claim 4, wherein the slot has a base and a protrusion projecting from the base to reduce a width of the slot in a central area of the slot.

* * * * *